US006161342A

United States Patent [19]

Barbier et al.

[11] Patent Number: 6,161,342

[45] Date of Patent: Dec. 19, 2000

[54] PREFABRICATED CONCRETE ELEMENT FOR BUILDING A CIVIL ENGINEERING STRUCTURE HAVING AN ARCHED WALL

[75] Inventors: Laurent Jean Barbier, Vanves; Alberto Antonio Melo Ferreira, Dompierre sur Besbre, both of France

[73] Assignee: Samflo, Malakoff, France

[21] Appl. No.: 09/230,093

[22] PCT Filed: Jul. 15, 1997

[86] PCT No.: PCT/FR97/01317

§ 371 Date: Mar. 17, 1999

§ 102(e) Date: Mar. 17, 1999

[87] PCT Pub. No.: WO98/03737

PCT Pub. Date: Jan. 29, 1998

[30] Foreign Application Priority Data

Jul. 24, 1996 [FR] France ..... 96 09600

[51] Int. Cl.[7] ..... E04B 1/32

[52] U.S. Cl. ..... 52/86; 52/89; 52/582.1; 52/436; 52/442; 52/587.1; 405/124; 405/125; 405/126

[58] Field of Search ..... 52/89, 86, 582.1, 52/436, 442, 587.1; 405/124, 125, 126

[56] References Cited

FOREIGN PATENT DOCUMENTS 2 682 141 A1 4/1993 France .

2 706 498 A1 12/1994 France .

2 723 116 A1 2/1996 France .

27 09 114 A1 9/1978 Germany .

OTHER PUBLICATIONS

*Passages inférieurs voûtes* [*"Arched Underpasses"*] of 1978, published by the General Interior Transport Directorate of the French Ministry of Transport.

*Primary Examiner*—Christopher T. Kent
*Assistant Examiner*—Dennis L. Dorsey
*Attorney, Agent, or Firm*—Oliff & Berridge, PLC

[57] ABSTRACT

A civil engineering structure having an arched wall including a plurality of curve shaped elements. Each element bears against one or more other similar elements and has a recess arranged in an outer face for casting a concrete assembly capping piece and reinforcements. Each element also includes at least one rigid bearing piece fastened to the element and has, at a free end of the rigid bearing piece, a surface with a non-planar profile. The rigid bearing piece comes to bear against a similar piece of another element located opposite it. The two rigid bearing pieces have complementary profiles making it possible for them to be wedged vertically.

12 Claims, 2 Drawing Sheets

PREFABRICATED CONCRETE ELEMENT FOR BUILDING A CIVIL ENGINEERING STRUCTURE HAVING AN ARCHED WALL

BACKGROUND OF THE INVENTION

The invention relates to a prefabricated concrete element intended to be assembled with other similar elements in order to form an arched wall of a civil engineering structure.

It is well known to arrange a passage under an embankment, in particular for a road traffic lane or for a watercourse, by means of a civil engineering structure comprising the arched wall.

The document entitled "Passages inférieurs voûtés" ["Arched Underpasses"] of 1978, published by the General Interior Transport Directorate of the French Ministry of Transport, describes such a civil engineering structure, consisting of a succession of curve shaped elements arranged side by side, forming the arched wall of the structure, and a raft or two parallel bearing sills supporting the curve shaped elements.

For conduits of small cross-section, the curve shaped elements forming the arch of the structure may substantially be semi-tubular in cross-section. Unfortunately, when the width at the base of the structure exceeds approximately five meters and the height exceeds approximately three meters, manufacturing and transporting the elements on site becomes practically impossible. In that case, the arched wall is produced, on one and the same segment of the structure, by assembling a plurality of the curve shaped elements.

Typically, the curve shaped elements each represent one half of the cross-section of the arched structure. The curve shaped elements bear against one another in the region of a keystone and are assembled by means of a concrete capping piece cast in situ.

According to a known assembly technique, the curve shaped elements have bearing faces provided with complementary profiled parts capable of interlocking and comprise emergent reinforcements projecting from their exterior.

The curve shaped elements bear directly against one another by being mutually wedged as a result of the interlocking of the profiled parts. The wedging of the interlocking parts allows for self-positioning of the curve shaped elements when the elements are assembled, thereby providing the advantage of reducing or even The emergent reinforcements of the curve shaped elements are subsequently connected by means of longitudinal reinforcements and are then embedded in cast concrete forming the assembly capping piece.

The capping piece is then arranged above the wall of the curve shaped elements. Unfortunately, the position of the capping piece is not conducive to the work of the arched wall when the arched wall undergoes stresses transmitted by the mass of the embankment or by the movement of the ground. In fact, in response to the above-described stresses, the curve-shaped elements deform and tend to pivot relative to one another about an axis located substantially at mid-height of their bearing faces. The curve shaped elements then transmit very high transverse stresses to the capping piece.

This frequently results in the appearance of cracks in the capping piece or in the curve shaped elements. The cracks considerably impair the resistance of the structure over a period of time.

Moreover, the construction of a longitudinal formwork in the upper part of the structure for the casting of the capping piece is a relatively difficult and complex operation.

The above-mentioned document of 1978 describes elements which are interrupted at a distance from the keystone and which comprise reinforcements projecting in the extension of their wall. Scaffolding having a height corresponding to the height of the arch is installed on the raft in line with the keystone. The scaffolding supports a plate having a curvature similar to the curvature of the arch. The curve shaped elements are subsequently placed on the raft and shored in such a way that the upper edges of each element face one another and come into contact with the plate. Then, the longitudinal reinforcements are connected to the reinforcements of the various elements, and the assembly as a whole is embedded in cast concrete. The plate forms a formwork base.

Thus, making it possible to obtain an arch which has a substantially homogenous structure.

However, because of the complexity of installation, the assembly is not used in practice. In fact, the scaffolding would be extremely difficult to mount, position the curve shaped elements by shoring so that they come into contact with the plate, put in place the reinforcements, which are of relatively complex design, cast a large quantity of concrete in order to carry out assembly, and then remove all the scaffolding.

French Patent Application No. 94.09607 describes a structure of the abovementioned type in which each curved element comprises a recess arranged in an outer face for casting the capping piece in a region of an end intended to be assembled with an end of another element, and reinforcements located in the recess, for assembling with the other elements. The recess is delimited in the region of a bottom of the element by projecting fillets.

The recesses of the various elements of the structure form a groove which may be filled with concrete in order to form an assembly capping piece when the elements are assembled opposite one another.

Although the structure is useful, it does suffer from several disadvantages.

In fact, the elements bear against one another only in the region of the ends of the fillets and are consequently balanced precariously. In order to keep the elements in position while the capping piece is being cast, it is necessary to place transverse pieces adjoining the elements. The transverse pieces are removed once the capping piece has been cast.

The above-described operations, which are carried out inside the structure and at the keystone, are relatively long and difficult to accomplish because the fillets are typically not aligned perfectly.

There is also a great risk that the elements will be dragged off, thus jeopardizing the safety of the personnel working on the site.

The result is that bringing the elements to bear is a difficult operation involving many precautions.

Furthermore, wedges are to be placed between the ends of the fillets so that the fillets do not come directly into contact with one another. Failing this, the elements would transmit high transverse stresses to the capping piece when experiencing deformation. As such, installing the wedges contributes to the structure being more complex to build.

French Patent Application No. 94.09607 further describes elements which have ground-bearing feet placed between loop-shaped reinforcements. The feet and loops are intended to be embedded in cast concrete to form a raft or sills. It is not very easy to engage the longitudinal reinforcements through the loop-shaped reinforcements in view of the presence of the feet. The adjustment of the position of the elements relative to the ground also presents problems in carrying out the engagement step.

French Patent Application No. 93.07578 describes a similar civil engineering structure having elements that bear against on another by means of projecting walls. The walls are on an inside of an upper part of the elements. Moreover, the walls delimit a bottom of a recess into which the capping piece is to be cast.

The walls are shaped to be connected, with the possibility of the elements being articulated relative to one another, thus entailing the risk that harmful lateral stresses will be exerted on the capping piece if one or more elements pivot relative to one or more other elements located opposite them.

SUMMARY OF THE INVENTION

An object of the invention is to overcome the above-mentioned disadvantages.

The element in question is intended to bear against one or more other oppositely located similar elements. The element in question is assembled with the other element or elements by means of a concrete capping piece to form the arched wall of a civil engineering structure. The element in question is similar to the type of element discussed in French Patent Application No. 94.09607.

According to the invention, each element comprises at least one rigid bearing piece fastened to the element. Each element also comprises, at a free end, a surface having a non-planar profile. When a first element is brought to bear against another element located opposite the first element, the rigid bearing piece of the first element bears against a similar rigid bearing piece of the other element. Since the two rigid bearing pieces have complementary profiles, an end of one piece is capable of engaging the end of the other piece in order to ensure the wedging of the elements.

The elements can thus be wedged perfectly while an assembly capping piece is being cast when being brought to bear against one another. The capping piece does not require formwork to be built and is arranged in the extension of the wall of the elements.

Any shoring, installation and removal of the transverse joining pieces and any risk that the elements will be dragged off are thereby eliminated.

The bearing pieces may comprise or receive connecting means, such as bolts, making it possible to ensure that the bearing pieces are connected to one another, should the casting of the capping piece be postponed.

Preferably, each bearing piece includes a profile, one part of which is embedded in the wall of the element and another part of which projects from the wall. Each bearing piece also includes a bearing plate fastened to the free end of this profile, the plate having, depending on whether the plate is placed on an element located on one side of the structure or on the element located opposite the latter, either a longitudinal cavity or a longitudinal projection intended to be received in the cavity, in order to allow the two plates to come into engagement.

A board may be fastened to the profile, so as to bear against the element in order to distribute the forces exerted by the latter on the concrete element.

Preferably, the element represents one half of the arched cross-section of the structure. A series of elements of the structure located on one side of the structure is offset by approximately one half-width of the element relative to the series of elements located on the other side of the structure. As such, each element comprises at least two bearing pieces located approximately at a quarter and three-quarters of a width of each element.

Each of the bearing pieces is opposite a bearing piece arranged in the corresponding part of one of the two elements located opposite one another. Thus, the mutual wedging of the various consecutive elements is ensured perfectly.

Advantageously, the reinforcements of the element are in the form of loops, and the bearing pieces, located between two consecutive reinforcements, are inscribed within the loops which the reinforcements form. The bearing pieces do not constitute an obstacle to the passage of the bars or longitudinal reinforcements connecting the reinforcements.

According to a preferred embodiment of the invention, the wall located on the inside of the element, in order to delimit the bottom of the recess, consists of a fillet integral with the element. The free end face of the fillet is set back slightly from the bearing interface of the bearing pieces.

The fillets of two elements located opposite one another thus come together so as to delimit the bottom of the recess receiving the concrete, which forms the capping piece. Alternatively, a plate may be attached to the mutually opposite elements, after being brought to bear on one another, in order to form the base of the formwork.

According to other features of the invention, the lower edge of each element comprises: loop-shaped reinforcements intended to be embedded in cast concrete forming a raft or bearing sills; at least two feet coming to bear against the ground, each of the feet including a profile having a width smaller than that of the reinforcements; and bearing plate fastened to the free end of this profile.

The profiles of the feet are no obstacle to the engagement of bars or reinforcements through the loops which the reinforcements form, thus making it easier to install the bars or reinforcements.

Advantageously, the feet are provided with adjusting means to adjust their length, and hence the height of the element relative to the ground. It thus becomes possible for the element to be positioned.

These and other objects of the inventory will be described in or be apparent from the following description of a preferred embodiment.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENT

Figure 1:
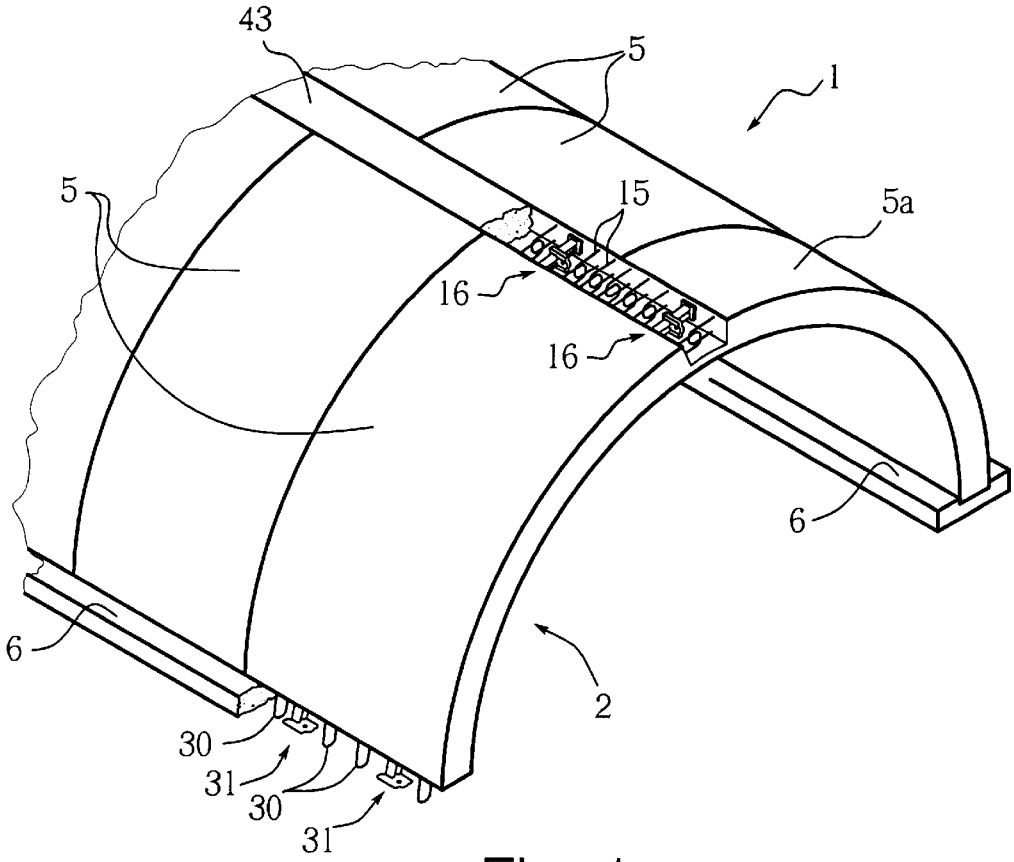
FIG. 1 is a perspective view of a civil engineering structure according to the invention including an arched wall, the arched wall having a plurality of prefabricated elements.

FIG. 1 shows a civil engineering structure 1 having an arched wall 2. The structure 1 is intended to be covered by an embankment and makes it possible to arrange a passage under the embankment, such as, for example, for a road traffic lane or a watercourse.

The structure 1 consists of a succession of curve shaped elements 5 arranged side by side to form the arched wall 2, and two parallel bearing sills 6 to support the elements 5.

The elements 5 each represent one half of the arched cross-section of the structure 1 and bear against one another in the region of the keystone.

The series of elements 5 located on one side of the structure 1 are offset by one half-width of an element 5 relative to elements 5 located on the other side of the structure 1. At its ends, the structure 1 comprises two half-elements 5*a,* the width of which is equal to half that of the elements 5, so that the structure 1 is interrupted by a plane end face.

Figure 2:
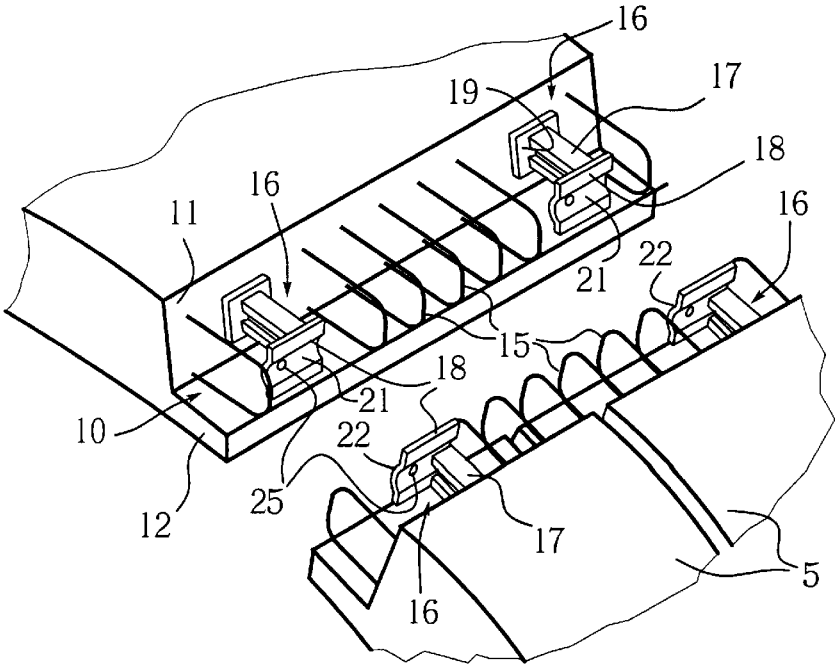
FIG. 2 is a partial enlarged perspective view of three of the elements according to the invention during installation.
Figure 3:
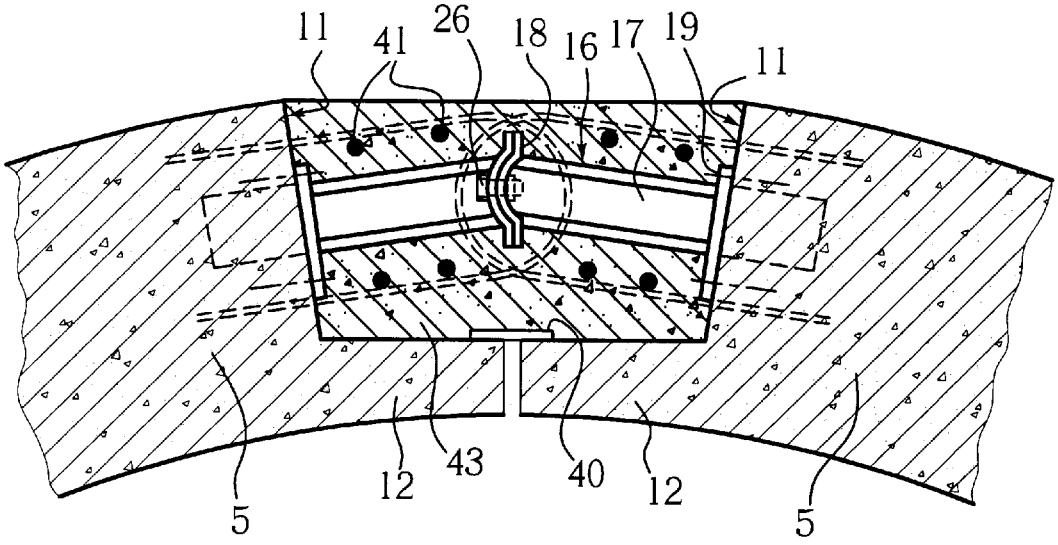
FIG. 3 is a partial cross-sectioned end view of an upper part of two elements after assembly, according to the invention.

FIGS. 2 and 3 show upper portions of two elements 5 located opposite one another.

Each element 5 has a recess 10 arranged in an outer face, the recess 10 being delimited laterally by an end face 11 and by a fillet 12 in a region of a bottom of the element 5. The fillet 12 is located on the inside of the element 5.

A first set of loop-shaped reinforcements 15 project from the end face 11. The reinforcements 15 are arranged in vertical planes, perpendicular to a longitudinal axis of the structure 1, and are offset relative to the reinforcements 15 of an element 5 located opposite thereto, so as to intersect when the elements 5 are assembled, as shown in FIG. 3.

Each element 5 further includes two rigid bearing pieces 16 fastened to the element 5 located approximately at a quarter and three-quarters of a width of the element 5. The pieces 16 project from the end face 11 and are located between two consecutive reinforcements 15. The pieces 16 are inscribed within the loops, which the reinforcements 15 form.

Each bearing piece 16 has a cross-section with an I-shaped profile 17, one part of which is embedded in the end face 11 of the element 5 and another part of which projects from the end face 11. A bearing plate 18 is fastened to a free end of the profile 17 and a board 19 is fastened to an attached end of the profile 17 embedded in the end face 11.

Each bearing plate 18 has either a longitudinal cavity 21 or a longitudinal projection 22 intended to be received in the cavity 21, so that two plates 18 can engage each other.

Furthermore, the bearing plates 18 comprise holes 25 capable of receiving bolts 26, as shown in FIG. 3.

As can be seen in FIGS. 2 and 3, the fillets 12 have a length such that, in the position in which corresponding elements 5 bear against one another, the free end faces 11 of the fillets 12 are set back slightly from the bearing interface of the plates 18.

Figure 4:
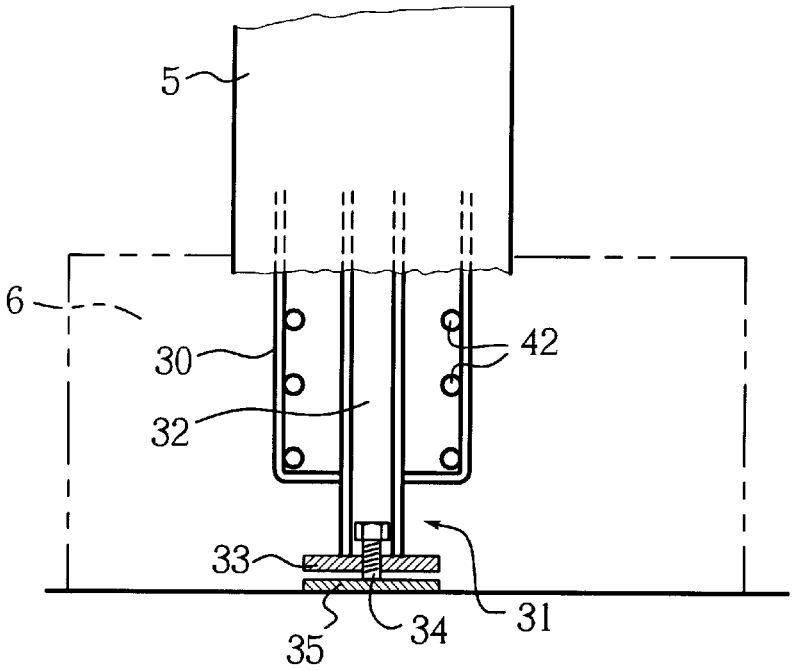
FIG. 4 is an englarged elevational view of a base of an element according to the invention.

As can be seen in FIGS. 1 and 4, a lower end face of each element 5 includes a second set of loop-shaped reinforcements 30 extending therefrom. The reinforcements 30 are ultimately embedded in cast concrete to form the sills 6. The lower end face of each element 5 also has at least two feet 31 extending therefrom to bear against the ground. Each of the feet 31 has a profile 32 with an I-shaped cross-section and a bearing plate 33 fastened to the free end of the profile 32.

The reinforcements 30 are also arranged in vertical planes, perpendicular relative to the longitudinal axis of the structure 1.

The feet 31 are located between two consecutive reinforcements 30 and are inscribed within the loops which the various reinforcements 30 form.

The bearing plates 33 have internally threaded holes for receiving screws 34. The screws 34 may bear against plates 35 placed on the ground or on so-called "blinding" concrete.

In practice, the elements 5 are brought to bear against one another in such a way that the various bearing plates 18 engage one another.

The screws 34 make it possible, where appropriate, to adjust the spacing between the plates 33 and 35, hence the height of each element 5 relative to the ground can also be adjusted.

An adhesive sealing tape 40 is placed astride the ends of the fillets 12.

Longitudinal reinforcements 41, 42 are engaged through the reinforcements 15 and 30, and formwork is built for the purpose of casting the sills 6. Concrete is subsequently poured into the groove which the aligned recesses 10 of the various elements 5 form, in order to constitute a capping piece 43 for assembling the elements 5, and into the formwork, in order to constitute the sills 6.

The bolts 26 ensure the plates 18 are kept in contact with one another, should the casting of the capping piece 43 be postponed.

The invention thus provides elements 5 having the numerous advantages mentioned above, in particular that whereby the said elements can be wedged perfectly, when they are brought to bear against one another, while the capping piece 43 is being cast, and that making it possible to obtain a capping piece 43 located in the extension of the wall of the elements 5, without formwork being built.

While the invention has been described in conjunction with specific embodiment thereof, it is evident that many alternatives, modifications and variations may be apparent to those skilled in the art. Accordingly, the preferred embodiment of the invention as set forth herein is intended to be illustrative, not limiting. Various changes may be made without departing from the spirit and scope of the invention.

What is claimed is:

1. A set of interconnectable prefabricated concrete elements to form an arched wall of a civil engineering structure, each element comprising:

a free end having an outer face;

a recess formed in the outer face;

a first set of reinforcements projecting from the outer face into the recess, the first set of reinforcements interconnecting the element to a corresponding first set of reinforcements of a corresponding element;

at least one rigid bearing piece fastened to the outer face of the free end, each rigid bearing piece projecting from the outer face into the recess and having a free end surface with a non-planar profile; and a capping piece cast in the recess, wherein when the element is brought to bear against the corresponding element having at least one corresponding rigid bearing piece with a free end having a profile complementary to the non-planar profile of the element, the corresponding element being located opposite the element, the non-planar profile of the free end of each rigid bearing piece engages the complimentary profile of the free end of the corresponding rigid bearing piece of the corresponding element to ensure the wedging of the element and the corresponding element.

2. The set of elements according to claim 1, wherein each rigid bearing piece comprises connecting means for connecting the element and corresponding element together.

3. The set of elements according to claim 1, wherein each rigid bearing piece has a bearing plate fastened to the free end having the non-planar profile, the bearing plate having one of either a longitudinal cavity or a longitudinal projection intended to be received in the longitudinal cavity so that the element can engage the corresponding element.

4. The set of elements according to claim 3, wherein each rigid bearing piece comprises a board fastened to the element from which each rigid bearing piece extends.

5. The set of elements according to claim 1, wherein each element represents one half of the arched wall of the civil engineering structure, and that a series of elements located on one side of the structure is offset by approximately one half-width of the element relative to a series of corresponding elements located on another side of the structure, and that the rigid bearing pieces of the elements and corresponding elements are located along approximately a quarter and three-quarters of a width of the elements and corresponding elements.

6. The set of elements according to claim 1, wherein the reinforcements of the first set of reinforcements are loops, and in that the rigid bearing pieces located between two consecutive reinforcements are inscribed within the loops.

7. The set of elements according to claim 1, wherein a bottom of the recess is a fillet integral with the element, a free end face of the fillet is set back from a bearing interface of each of the rigid bearing pieces.

8. The set of elements according to claim 1, wherein a bottom end of each element further comprises:

a second set of reinforcements extending from the bottom end, the second set of reinforcements capable of being embedded in cast concrete forming one of either a raft or bearing sills; and at least two feet extending from the bottom end and being capable of bearing against a ground surface, each of the feet having a profile with a width smaller than a width of the second set of reinforcements and a width of a bearing plate fastened to a free end of the profile.

9. The set of elements according to claim 8, wherein the feet have adjusting means for adjusting a vertical height of each element relative to the ground surface.

10. The set of elements according to claim 2, wherein the connecting means are bolts.

11. The set of elements according to claim 8, wherein each reinforcement of the second set of reinforcements is loop-shaped.

12. The set of elements according to claim 9, wherein the adjusting means are a plate and a plurality of receiving screws that engage a bottom surface of the bearing plate.

* * * * *